US007458785B2

(12) United States Patent
Murakami et al.

(10) Patent No.: US 7,458,785 B2
(45) Date of Patent: Dec. 2, 2008

(54) COMPRESSOR WITH LUBRICATION STRUCTURE

(75) Inventors: Tomohiro Murakami, Kariya (JP); Sokichi Hibino, Kariya (JP); Atsuyuki Morishita, Kariya (JP)

(73) Assignee: Kabushiki Kaisha Toyota Jidoshokki, Kariya-Shi (JP)

( * ) Notice: Subject to any disclaimer, the term of this patent is extended or adjusted under 35 U.S.C. 154(b) by 842 days.

(21) Appl. No.: 10/770,730

(22) Filed: Feb. 2, 2004

(65) Prior Publication Data

US 2004/0170504 A1 Sep. 2, 2004

(30) Foreign Application Priority Data

Feb. 4, 2003 (JP) ..... 2003-027400

(51) Int. Cl.
*F04B 1/12* (2006.01)

(52) U.S. Cl. ..... 417/269

(58) Field of Classification Search ..... 417/53, 417/222, 269, 437, 312, 313, 540; 92/71, 92/72; 184/6
See application file for complete search history.

(56) References Cited

U.S. PATENT DOCUMENTS

| | | | | | |
|---|---|---|---|---|---|
| 4,127,363 | A * | 11/1978 | Kato et al. | ..... | 417/269 |
| 4,221,544 | A | 9/1980 | Ohta | ..... | 417/269 |
| 4,321,019 | A * | 3/1982 | Degawa et al. | ..... | 417/269 |
| 4,401,414 | A * | 8/1983 | Ishizuka | ..... | 417/269 |
| 5,183,394 | A * | 2/1993 | Fujii et al. | ..... | 417/269 |
| 5,393,205 | A * | 2/1995 | Fujii et al. | ..... | 417/269 |
| 5,419,685 | A * | 5/1995 | Fujii et al. | ..... | 417/269 |
| 6,247,901 | B1 * | 6/2001 | Unger | ..... | 417/223 |
| 6,402,480 | B1 * | 6/2002 | Sud et al. | ..... | 417/222.1 |
| 6,558,133 | B2 | 5/2003 | Fukanuma et al. | ..... | 417/222.2 |
| 6,675,607 | B2 * | 1/2004 | Tarutani et al. | ..... | 62/469 |
| 2003/0089123 | A1 | 5/2003 | Tarutani et al. | ..... | 62/469 |
| 2003/0113211 | A1 | 6/2003 | Moroi et al. | ..... | 417/222.2 |

FOREIGN PATENT DOCUMENTS

| | | |
|---|---|---|
| CN | 1354325 | 6/2002 |
| EP | 0 943 802 A2 | 9/1999 |
| EP | 0 965 804 A2 | 12/1999 |
| JP | 5-231309 | 9/1993 |
| JP | 6-123280 | 5/1994 |
| JP | 10-281060 | 10/1998 |
| JP | 2002-213350 | 7/2002 |
| JP | 2003-28066 | 1/2003 |

* cited by examiner

*Primary Examiner*—Devon Kramer
*Assistant Examiner*—Vikansha Dwivedi
(74) *Attorney, Agent, or Firm*—Morgan & Finnegan, LLP

(57) ABSTRACT

A supply passage is formed in a rotary shaft along the axis thereof. An expansion passage is formed in the rotary shaft in such a way as to be led to the supply passage. A pair of fluid passages are formed in the rotary shaft in such a way as to communicate with the expansion passage. The fluid passages extend in a direction orthogonal to the axis and the outlet ports of the fluid passages are open to the outer surface of the rotary shaft. The fluid passages extend from the expansion passage to a control pressure chamber, penetrating through the rotary shaft.

20 Claims, 7 Drawing Sheets

COMPRESSOR WITH LUBRICATION STRUCTURE

BACKGROUND OF THE INVENTION

The present invention relates to a compressor with a lubrication structure that causes pistons to respond to rotation of a rotary shaft via a driving body that rotates together with the rotary shaft, and compresses gas by compression action of the pistons.

Portions in the compressor that need lubrication should be lubricated with lubricating oil. The lubricating oil flows with the refrigerant that circulates in the compressor. To suppress the flow of the lubricating oil out of the compressor, some measures are taken as disclosed in, for example, Japanese Laid-Open Patent Publication No. 10-281060 and Japanese Laid-Open Patent Publication No. 2002-213350.

Japanese Laid-Open Patent Publication No. 10-281060 discloses a compressor in which a cylindrical oil separator is retained in a discharge chamber. As the refrigerant gas is circulated around the oil separator, the centrifugal action separates the lubricating oil from the refrigerant gas.

Japanese Laid-Open Patent Publication No. 2002-213350 discloses a compressor in which a substantially cylindrical oil separator is disposed in a bleed passage that connects a crank chamber to a suction chamber. The oil separator is coupled to the drive shaft and rotates with the drive shaft. As the oil separator rotates, the lubricating oil in the refrigerant gas that flows in the bleed passage is separated by the centrifugal action.

However, the use of either of the oil separators as disclosed in those two publications increases the number of components of the compressor. This requires space for provision of the new components, and thus enlarges the compressor.

SUMMARY OF THE INVENTION

Accordingly, it is an objective of the present invention to provide a lubrication structure that adequately lubricates components of a compressor that need lubrication while avoiding size enlargement of the compressor.

To achieve the foregoing and other objectives and in accordance with the purpose of the present invention, a compressor with a lubrication structure is provided. The compressor includes a rotary shaft, a piston, a driving body accommodating chamber, a gas passage, and a fluid passage. The driving body is accommodated in the driving body accommodating chamber. The driving body converts rotation of the rotary shaft into reciprocation of the piston, thereby causing the piston to compress gas. The gas passage extends through the rotary shaft and communicates with the driving body accommodating chamber. The gas passage includes an expansion portion. The fluid passage is formed in the rotary shaft to connect the expansion portion with the driving body accommodation chamber. The maximum cross-sectional area of the expansion portion is greater than the maximum cross-sectional area of a section of the gas passage that is upstream of the expansion portion.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which:

FIG. 4(*b*) is a cross-sectional view taken along the line 4*b*-4*b* in FIG. 4(*a*);

FIG. 13(*b*) is a cross-sectional view taken along the line 13*b*-13*b* in FIG. 13(*a*).

DETAILED DESCRIPTION OF THE PREFERRED EMBODIMENTS

A variable displacement compressor 10 according to a first embodiment of the invention will now be described with reference to FIGS. 1 to 4(*b*).

Figure 1:
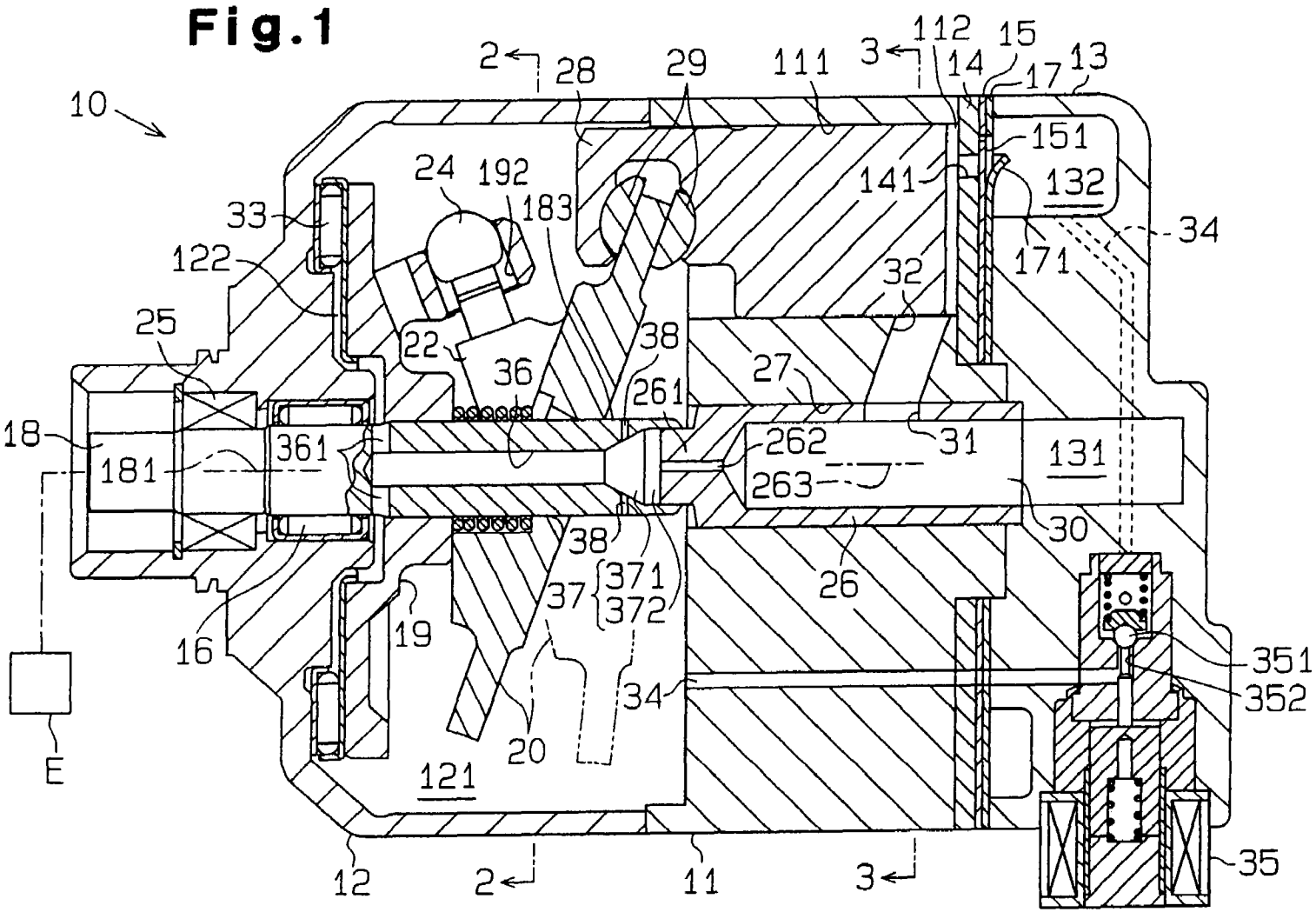
FIG. 1 is a cross-sectional view of a compressor according to a first embodiment of the present invention.

As shown in FIG. 1, a front housing member 12 is connected to the front end of a cylinder block 11. A rear housing member 13 is securely connected to the rear end of the cylinder block 11 via a main valve plate 14, a sub valve plate 15 and a retainer plate 17. The cylinder block 11, the front housing member 12, and the rear housing member 13 constitute the housing of the compressor 10. The left end of the compressor 10 as viewed in FIG. 1 is defined as the front end, and the right end of the compressor 10 is defined as the rear end. A rotary shaft 18 is rotatably supported on the front housing member 12, which forms a control pressure chamber 121 as a driving body accommodating chamber, via a radial bearing 16. The rotary shaft 18 protruding outward from the control pressure chamber 121 acquires drive force from a vehicle engine E as an external drive source via a pulley (not shown) and a belt (not shown). A lip-seal type shaft sealing assembly 25 intervenes between the front housing member 12 and the rotary shaft 18.

Figure 2:
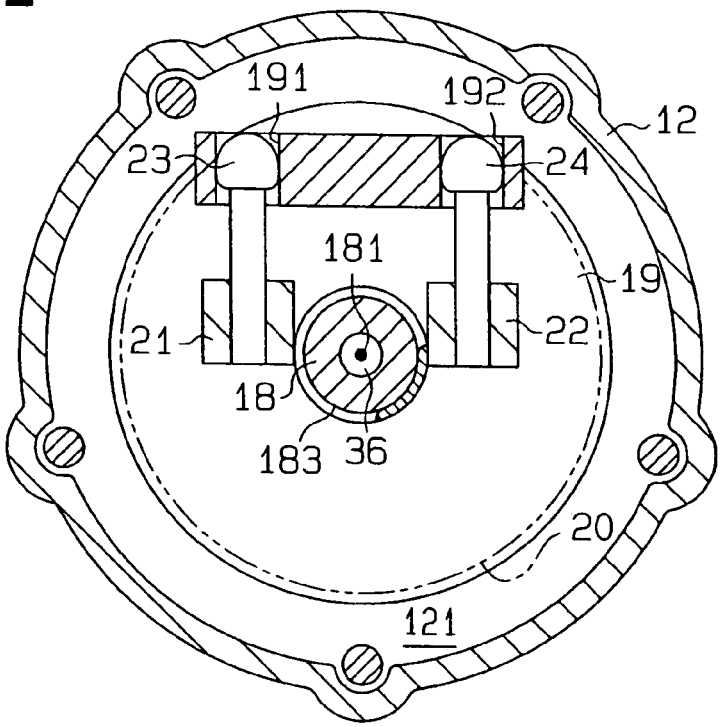
FIG. 2 is a cross-sectional view taken along the line 2-2 in FIG. 1.

A rotary support 19 is fixed to the rotary shaft 18. A swash plate 20 as a driving body is supported on the rotary shaft 18 in such a way as to be slidable and tiltable along the direction of an axis 181 of the rotary shaft 18. As shown in FIG. 2, a pair of pin supports 21 and 22 are fixed to the swash plate 20 and guide pins 23 and 24 are respectively fixed to the pin supports 21 and 22. A pair of guide holes 191 and 192 are formed in the rotary support 19. The head portions of the guide pins 23 and 24 are slidably inserted in the respective guide holes 191 and 192. The combination of the pair of guide holes 191 and 192 and the associated guide pins 23 and 24 allows the swash plate 20 to tilt in the direction of the axis 181 of the rotary shaft 18 and rotate together with the rotary shaft 18.

The tilting of the swash plate 20 is guided by the slide-guide relationship between the guide holes 191 and 192 and the guide pins 23 and 24 and the slide-support action of the rotary shaft 18.

As the center portion of the swash plate 20 moves toward the rotary support 19, the tilt angle of the swash plate 20 increases. The maximum tilt angle of the swash plate 20 is defined by the abutment of the swash plate 20 on the rotary support 19. At the position of the swash plate 20 that is indicated by the solid line in FIG. 1, the tilt angle of the swash plate 20 becomes maximum. As the center portion of the swash plate 20 moves toward the cylinder block 11, the tilt angle of the swash plate 20 decreases. At the position of the swash plate 20 that is indicated by the two-dot chain line in FIG. 1, the tilt angle of the swash plate 20 becomes minimum.

Pistons 28 are retained in associated cylinder bores 111 formed in the cylinder block 11. The rotation of the swash plate 20 is converted to the reciprocation of the pistons 28 via shoes 29 so that the pistons 28 reciprocate in the cylinder bores 111. Each piston 28 defines a compression chamber 112 in the associated cylinder bore 111.

As shown in FIG. 1, a suction chamber 131 and a discharge chamber 132 are defined in the rear housing member 13. A discharge port 141 is formed in the main valve plate 14 and a discharge valve 151 is provided at the sub valve plate 15. As the discharge valve 151 abuts on a retainer 171 on the retainer plate 17, opening degree of the discharge valve 151 is restricted.

A rotary valve 26 is supported rotatably in the cylinder block 11. The rotary valve 26 is inserted into a support hole 27 bored through the cylinder block 11. The rotary valve 26 is coupled to the rotary shaft 18. That is, the rotary valve 26 rotates together with the rotary shaft 18. The rotary valve 26, which rotates with the rotary shaft 18, is directly supported by the cylinder block 11 via the support hole 27.

A supply passage 30 is formed in the rotary valve 26 along the direction of the axis 181 of the rotary shaft 18. The supply passage 30 communicates with the suction chamber 131 as a suction pressure zone. An inlet passage 31 is formed in the rotary valve 26 in such a way as to communicate with the supply passage 30.

Figure 3:
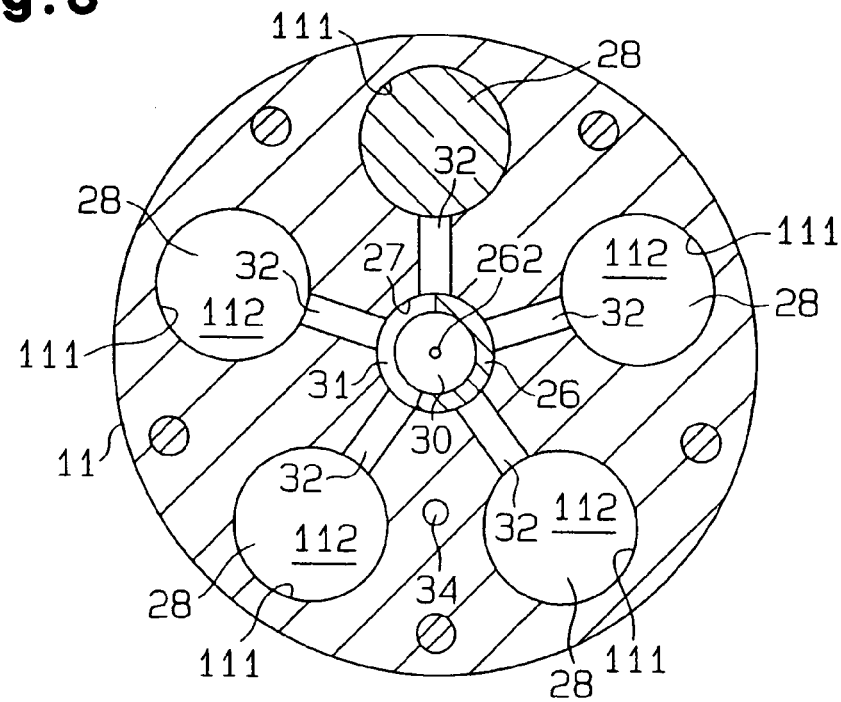
FIG. 3 is a cross-sectional view taken along the line 3-3 in FIG. 1.

As shown in FIG. 3, a suction passage 32 is formed in the cylinder block 11 in such a way as to connect the cylinder bore 111 to the support hole 27. The suction passage 32 is opened at the circumferential surface of the support hole 27. As the rotary shaft 18 and the rotary valve 26 rotate, the inlet passage 31 intermittently communicates with the suction passage 32.

When the piston 28 is in a stroke of moving from the top dead center to the bottom dead center, the refrigerant gas in the supply passage 30 in the rotary valve 26 is sucked into the compression chamber 112 of the cylinder bore 111 via the inlet passage 31 and the suction passage 32.

When the piston 28 is in a stroke of moving from the bottom dead center to the top dead center, on the other hand, the refrigerant gas in the compression chamber 112 presses the discharge valve 151 backward through the discharge port 141 and is discharged to the discharge chamber 132. The refrigerant discharged to the discharge chamber 132 as a discharge pressure zone flows out to an unillustrated external refrigerant circuit outside the compressor. The refrigerant that has flowed to the external refrigerant circuit circulates to the suction chamber 131.

A refrigeration circuit, which comprises the compressor and the external refrigerant circuit, holds lubricating oil that flows with the refrigerant.

As shown in FIG. 1, a thrust bearing 33 intervenes between the rotary support 19 and the front housing member 12. The thrust bearing 33 receives the discharge reaction force, which acts on the rotary support 19, from the compression chamber 112 via the piston 28, the shoes 29, the swash plate 20, the pin supports 21 and 22 and the guide pins 23 and 24. There is a clearance 122 between the rotary support 19 and the front housing member 12.

A feed passage 34 that connects the discharge chamber 132 to the control pressure chamber 121 is formed in the cylinder block 11 and the rear housing member 13. A displacement control valve 35 of an electromagnetic type is provided on the feed passage 34. The displacement control valve 35 is controlled by electromagnetic excitation/de-excitation. When the displacement control valve 35 is de-excited, a valve body 351 opens a valve hole 352, feeding the refrigerant gas in the discharge chamber 132 to the control pressure chamber 121 via the feed passage 34. When the displacement control valve 35 is excited, the valve body 351 closes the valve hole 352, stopping the supply of the refrigerant from the discharge chamber 132 to the control pressure chamber 121.

A guide passage 36 is formed in the rotary shaft 18 along the axis 181. The cross-sectional area of the guide passage 36 is the same at anywhere in the guide passage 36. A pair of inlets 361 that communicate with the guide passage 36 is formed in the rotary shaft 18. Each inlet 361 faces the clearance 122.

Figure 4A:
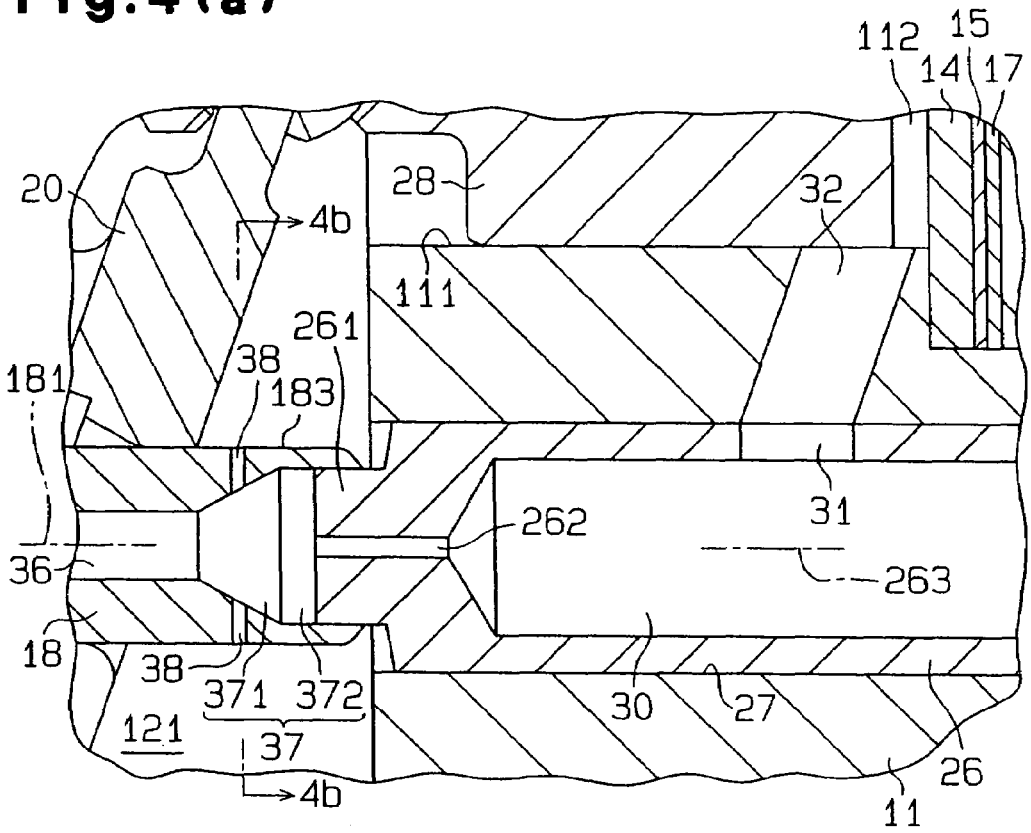
FIG. 4(*a*) is an enlarged partial cross-sectional view of the compressor in FIG. 1.
Figure 4B:
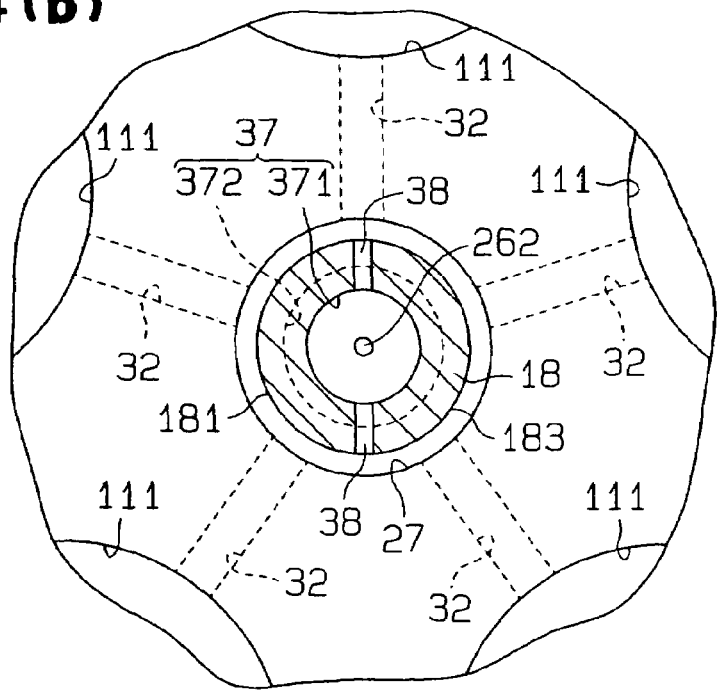

As shown in FIGS. 1 and 4(*a*), an expansion passage 37 is formed in the rotary shaft 18 in such a way as to communicate with the guide passage 36. The expansion passage 37 includes a cone portion 371 and a circumferential portion 372. The guide passage 36 communicates with the minimum-diameter portion of the cone portion 371 and the circumferential portion 372 communicates with the maximum-diameter portion of the cone portion 371. The cross-sectional area of the cone portion 371 is larger than the cross-sectional area of the guide passage 36 and the cross-sectional area of the circumferential portion 372 is the area of the largest portion of the expansion passage 37. The total of the cross-sectional areas of the pair of inlets 361 is set equal to or smaller than the cross-sectional area of the guide passage 36.

As shown in FIGS. 4(*a*) and 4(*b*), a pair of fluid passages 38 are formed in the rotary shaft 18 in such a way as to communicate with the circumferential wall of the cone portion 371 of the expansion passage 37. The fluid passages 38 extend in a direction orthogonal to the axis 181 and their outlet ports are open to the control pressure chamber 121.

As shown in FIG. 4(*a*), the rotary valve 26 has a small-diameter link portion 261. The link portion 261 is fitted into the circumferential portion 372 by pressure. A restriction passage 262 is formed in the link portion 261 along an axis 263 of the rotary valve 26. The axis 181 of the rotary shaft 18 is coaxial to the axis 263 of the rotary valve 26. The expansion passage 37 and the supply passage 30 communicate with each other via the restriction passage 262. The cross-sectional area of the restriction passage 262 is constant anywhere in the restriction passage 262. The cross-sectional area of the restriction passage 262 is smaller than the cross-sectional area of the guide passage 36.

When the displacement control valve 35 is closed, the supply of the refrigerant to the control pressure chamber 121 from the discharge chamber 132 is stopped. The refrigerant gas in the control pressure chamber 121 flows out to the supply passage 30 via the clearance 122, the inlet 361, the guide passage 36, the expansion passage 37 and the restriction passage 262. The radial bearing 16 and the thrust bearing 33 are lubricated by the lubricating oil that flows with the refrigerant gas flowing in the clearance 122. As the refrigerant gas in the control pressure chamber 121 flows out to the supply passage 30 via the guide passage 36, the expansion passage 37 and the restriction passage 262, the pressure in the control pressure chamber 121 drops. Therefore, the tilt angle of the swash plate 20 increases, increasing the displacement. When the displacement control valve 35 is opened, the refrigerant gas in the discharge chamber 132 is supplied to the control pressure chamber 121. Therefore, the pressure in the control pressure chamber 121 rises, reducing the tilt angle of the swash plate 20 so that displacement decreases.

The pair of inlets 361, the guide passage 36, the expansion passage 37 and the restriction passage 262 constitute a bleed passage. The refrigerant in the control pressure chamber 121 is bled through the bleed passage to the supply passage 30, which is a part of the suction pressure zone. The bleed passage functions as a gas passage provided in the rotary shaft 18 in such a way as to communicate with the control pressure chamber 121 (driving body accommodating chamber.), which retains the swash plate 20 as a driving body.

The maximum cross-sectional area of the expansion passage 37, i.e., the cross-sectional area of the circumferential portion 372, is larger than the cross-sectional area of the guide passage 36 located upstream of the expansion passage 37 with regard to the flow of the refrigerant gas.

The refrigerant gas having passed through the guide passage 36 receives the centrifugal action, which is caused by the rotation of the rotary shaft 18, in the expansion passage 37. The lubricating oil that flows with the refrigerant gas in the guide passage 36 is separated from the refrigerant gas by the centrifugal action in the expansion passage 37. The lubricating oil separated from the refrigerant gas is guided to each fluid passage 38 by the centrifugal action in the fluid passage 38. The lubricating oil having flown into the fluid passage 38 flows out into the control pressure chamber 121 by the centrifugal action in the fluid passage 38. The lubricating oil having flown into the control pressure chamber 121 from the expansion passage 37 is used to lubricate portions in the control pressure chamber 121, which need lubrication.

This embodiment has the following advantages.

(1) The structure that has the bleed passage provided in the rotary shaft 18 and the expansion passage 37 provided in the bleed passage eliminates the need for additional space to separate the lubricating oil from the refrigerant gas outside the rotary shaft 18. This prevents the compressor from becoming larger.

(2) The refrigerant gas in the control pressure chamber 121 flows into the supply passage 30 via the clearance 122 and the bleed passage in the rotary shaft 18. Therefore, the thrust bearing 33 and the radial bearing 16 are lubricated by the lubricating oil that flows with the refrigerant gas flowing in the clearance 122. That is, the structure that has the bleed passage provided in the rotary shaft 18 in the variable displacement compressor is effective in adequately lubricating the thrust bearing 33 and the radial bearing 16.

(3) The restriction passage 262 functions so as to set the flow rate of the refrigerant in the bleed passage to the proper flow rate. The restriction passage 262 having a small cross-sectional area functions to reduce the flow speed of the refrigerant gas in the expansion passage 37. Accordingly, the centrifugal action in the expansion passage 37 effectively acts on the lubricating oil, which flows with the refrigerant gas, so that the lubricating oil is separated from the refrigerant gas efficiently. In addition, the restriction passage 262 suppresses the flow of the lubricating oil, separated from the refrigerant gas in the expansion passage 37, into the supply passage 30.

(4) The lubricating oil separated from the refrigerant gas in the expansion passage 37 is thrust toward the inner wall of the expansion passage 37 by the centrifugal action. Therefore, there is very small ratio of the lubricating oil flowing to the restriction passage 262 on the axis 263 of the rotary valve 26. In other words, the structure that is provided with the expansion passage 37 is effective in suppressing the flow-out of the separated lubricating oil to the supply passage 30.

(5) It is easy to form the restriction passage 262 in the rotary valve 26 separate from the rotary shaft 18 at the downstream of the expansion passage 37, that is, the rotary valve 26 is suitable as the location where the restriction passage 262 is formed.

A second embodiment of the present invention is described below referring to FIG. 5. To avoid the redundant description, like or the same reference numerals are given to those constituents of the second to seventh embodiments in FIGS. 5 to 10 that are the same as the corresponding constituents of the first embodiment in FIGS. 1 to 4(*b*).

Figure 5:
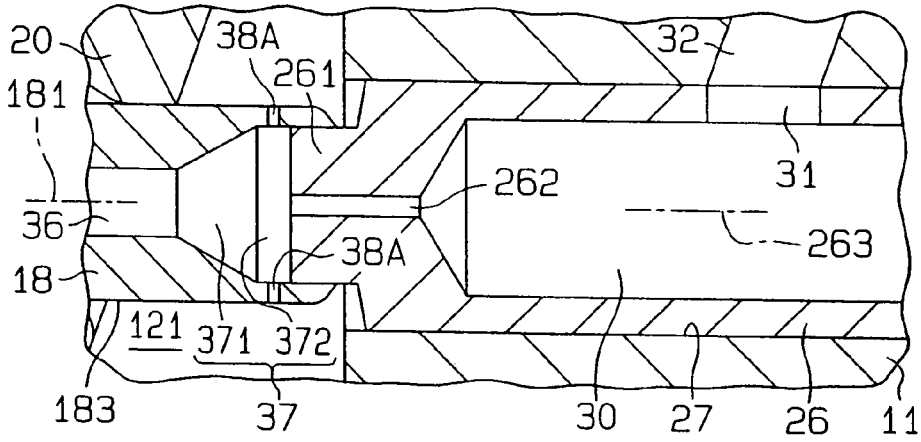
FIG. 5 is a partial cross-sectional view illustrating a second embodiment.

As shown in FIG. 5, a fluid passage 38A communicates with the circumferential portion 372 in such a way as to be open to the inner wall of the circumferential portion 372. Of the inner wall of the expansion passage 37, the inner wall of the circumferential portion 372 has the largest diameter of the expansion passage 37. The lubricating oil separated from the refrigerant gas is most likely to be gathered at the circumferential portion 372. Therefore, the fluid passages 38A can suitably supply the lubricating oil separated in the expansion passage 37 to the control pressure chamber 121.

Figure 6:
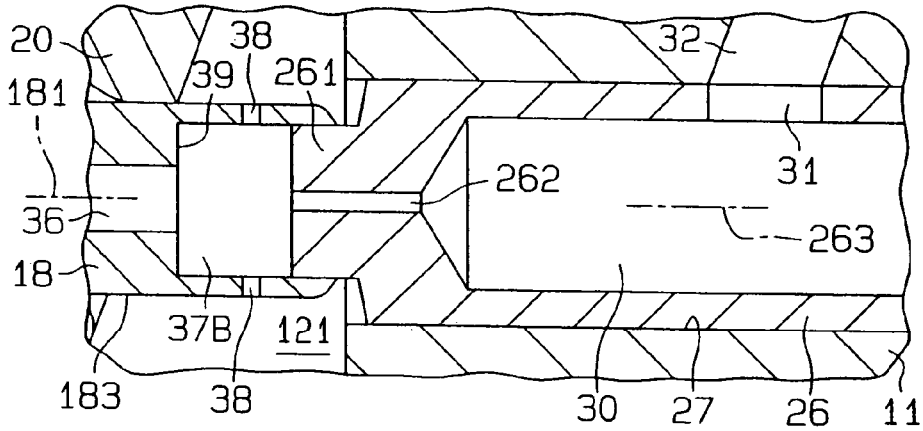
FIG. 6 is a partial cross-sectional view illustrating a third embodiment.

In the third embodiment in FIG. 6, an expansion passage 37B has a cylindrical shape and a step 39 is provided between the guide passage 36 and the expansion passage 37B. This embodiment has advantages similar to those of the first embodiment in FIGS. 1 to 4(*b*).

Figure 7:
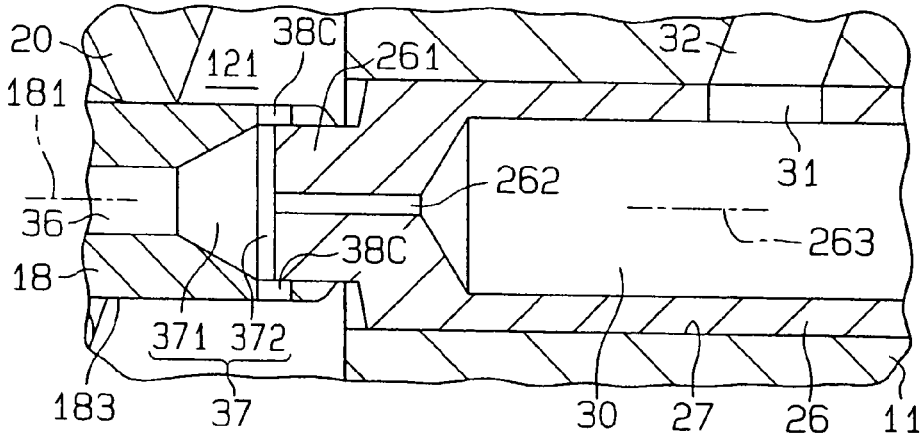
FIG. 7 is a partial cross-sectional view illustrating a fourth embodiment.

In the fourth embodiment in FIG. 7, a part of the opening of a fluid passage 38C is covered with the link portion 261 of the rotary valve 26. This design makes the diameter of the fluid passage 38C relatively large, thus facilitating the boring of the fluid passage 38C.

Figure 8:
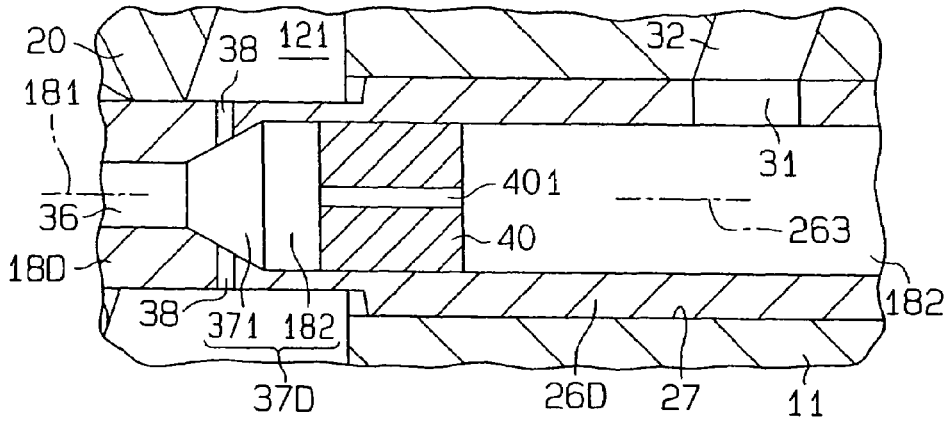
FIG. 8 is a partial cross-sectional view illustrating a fifth embodiment.

In the fifth embodiment in FIG. 8, a part of a rotary shaft 18D constitutes a rotary valve 26D. That is, the rotary shaft 18D and the rotary valve 26D are formed integral with each other. A circumferential portion 182 is formed in the rotary shaft 18D and a columnar shutter 40 is fitted in the circumferential portion 182. A restriction passage 401 is formed in the shutter 40. The restriction passage 401 connects the circumferential portion 182 upstream of the shutter 40 to the circumferential portion 182 downstream of the shutter 40. The circumferential portion 182 upstream of the shutter 40, together with the cone portion 371, constitutes an expansion passage 37D, and the circumferential portion 182 downstream of the shutter 40 constitutes a supply passage that communicates with the suction chamber 131 and the inlet passage 31.

This embodiment has the first through forth described advantages of the first embodiment in FIGS. 1 to 4(*b*).

Figure 9:
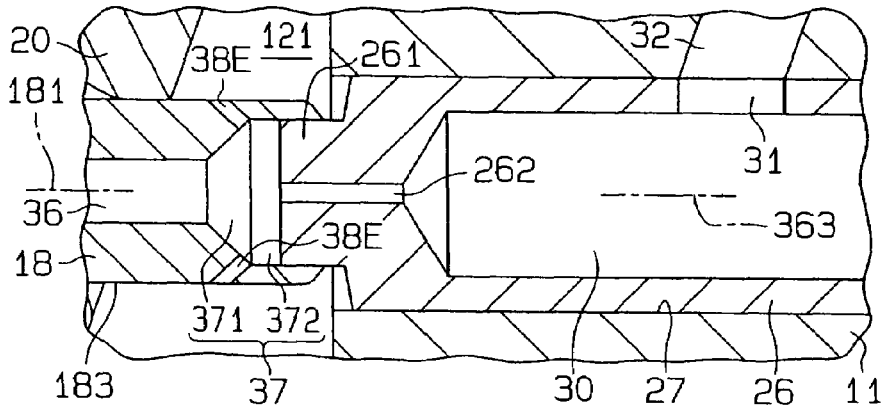
FIG. 9 is a partial cross-sectional view illustrating a sixth embodiment.

In the sixth embodiment in FIG. 9, fluid passages 38E are so formed as to be open to the outer wall of the cone portion 371. The axis of the fluid passage 38E passing the outer wall of the cone portion 371 tilts against the axis 181. This makes it easy to bore the hole for the fluid passage 38E from the outer wall side of the cone portion 371.

This embodiment also has advantages similar to those of the first embodiment in FIGS. 1 to 4(*b*).

Figure 10:
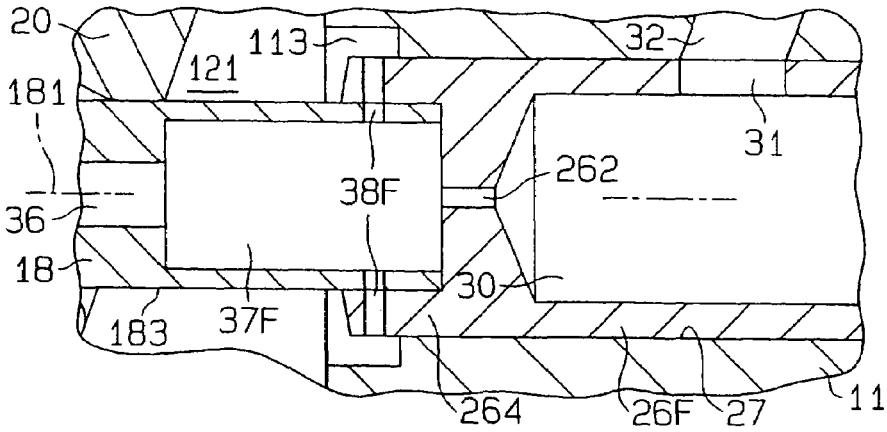
FIG. 10 is a partial cross-sectional view illustrating a seventh embodiment.

In the seventh embodiment in FIG. 10, a cylindrical link portion 264 is formed in a rotary valve 26F. The rotary shaft 18 is fitted into the inner circumference of the link portion 264 by pressure. A recess 113 is formed in the end face of the cylinder block 11 around the link portion 264. A cylindrical expansion passage 37F is formed in the rotary shaft 18. Fluid passages 38F, which connect the expansion passage 37F to the recess 113, are formed in the rotary shaft 18 and the link portion 264.

As the outside diameter of the link portion 264 is larger than the outside diameter of the rotary shaft 18, the force of inertia at the outer surface of the link portion 264 is greater than that at the outer surface, 183, of the rotary shaft 18. Therefore, the centrifugal action in the fluid passage 38F is greater than the centrifugal action in the fluid passage that is formed in such a way as to be open to the outer surface 183 of the rotary shaft 18. The structure in which the fluid passages 38F are formed in such a way as to be open to the outer surface of the link portion 264 is advantageous over the structure in which the fluid passages are formed in such a way as to be open to the outer surface 183 of the rotary shaft 18 from the viewpoint of efficiently feeding the lubricating oil, separated in the expansion passage, to the fluid passages 38F.

An eighth embodiment of the present invention as embodied into a fixed displacement piston type compressor is described below with reference to FIGS. 11 to 13(*b*).

Figure 11:
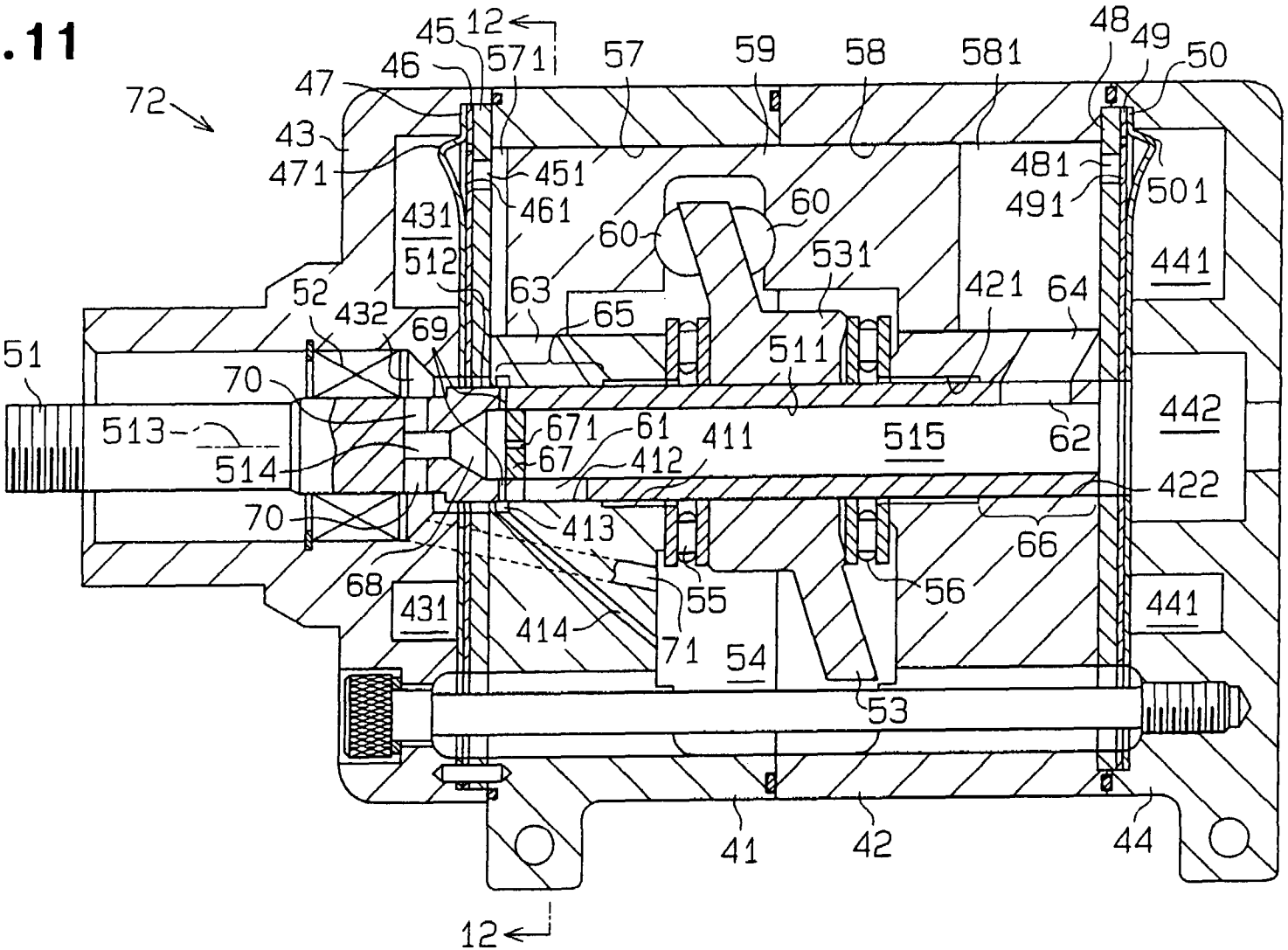
FIG. 11 is a cross-sectional view illustrating the general structure of a compressor according to an eighth embodiment.

As shown in FIG. 11, a front housing member 43 and a rear housing member 44 are respectively connected to a pair of connected cylinder blocks 41 and 42. The connected cylinder blocks 41 and 42, the front housing member 43 and the rear housing member 44 constitute the housing of a compressor 72. The left end of the compressor 72 as viewed in FIG. 11 is defined as the front end, and the right end of the compressor 72 is defined as the rear end. A first discharge chamber 431 is formed in the front housing member 43. A second discharge chamber 441 and a suction chamber 442 are formed in the rear housing member 44.

A first main valve plate 45, a first sub valve plate 46 and a first retainer plate 47 are provided between the first cylinder block 41 and the front housing member 43. A second main valve plate 48, a second sub valve plate 49 and a second retainer plate 50 are provided between the second cylinder block 42 and the rear housing member 44. First and second discharge ports 451 and 481 are respectively formed in both main valve plates 45 and 48, and first and second discharge valves 461 and 491 are respectively formed in both sub valve plates 46 and 49. The discharge valves 461 and 491 open and close the associated discharge ports 451 and 481. Retainers 471 and 501 are formed at the respective retainer plates 47 and 50. The first and second retainers 471 and 501 restrict the opening degree of the associated discharge valves 461 and 491.

A rotary shaft 51 is rotatably supported on both cylinder blocks 41 and 42. The rotary shaft 51 is inserted into shaft holes 411 and 421 bored through the respective cylinder blocks 41 and 42.

A lip-seal type shaft sealing assembly 52 intervenes between the front housing member 43 and the rotary shaft 51. The shaft sealing assembly 52 is retained in a retaining chamber 432 formed in the front housing member 43. The first discharge chamber 431 of the front housing member 43 is provided around the retaining chamber 432.

A swash plate 53 is secured to the rotary shaft 51. The swash plate 53 as a driving body is retained in a swash plate chamber 54 as a driving body accommodating chamber. Thrust bearings 55 and 56 intervene between the cylinder blocks 41 and 42, and the base portion 531 of the swash plate 53. The thrust bearings 55 and 56 restrict the position of the rotary shaft 51 in the direction of an axis 513 thereof with the swash plate 53 in between.

Figure 12:
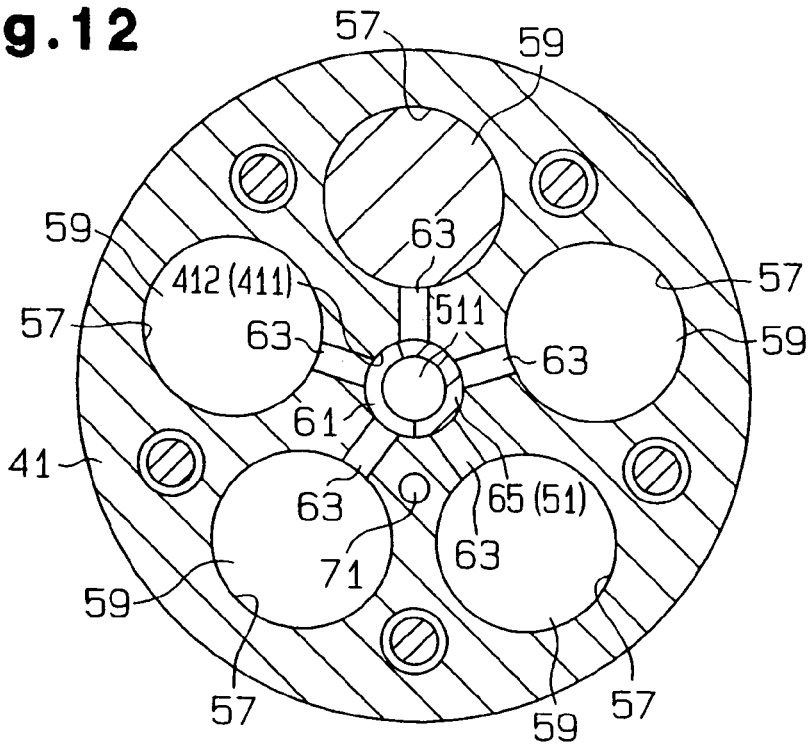
FIG. 12 is a cross-sectional view taken along the line 12-12 in FIG. 11.

As shown in FIG. 12, first cylinder bores 57, the number of which is five in this embodiment, are formed in the first cylinder block 41 in such a way as to be laid out at equal angular distances around the axis 513 of the rotary shaft 51. Second cylinder bores 58 equal in number to the first cylinder bores 57 are likewise formed in the second cylinder block 42 in such a way as to be laid out at equal angular distances around the axis 513 of the rotary shaft 51. A double-headed piston 59 is retained in a pair of cylinder bores 57 and 58.

As shown in FIG. 11, the rotation of the swash plate 53, which rotates with the rotary shaft 51, is transmitted to the double-headed piston 59 via shoes 60 so that the double-headed piston 59 reciprocates in the pair of cylinder bores 57 and 58. Each double-headed piston 59 defines first and second compression chambers 571 and 581 in the associated first and second cylinder bores 57 and 58.

Formed on the inner surfaces of both shaft holes 411 and 421 are associated seal surfaces 412 and 422. The diameters of the first and second seal surfaces 412 and 422 are smaller than the diameters of the inner surfaces of the shaft holes 411 and 421 which excludes both seal surfaces 412 and 422. The rotary shaft 51 is supported by both cylinder blocks 41 and 42 via the seal surfaces 412 and 422.

A guide passage 511 is formed in the rotary shaft 51. One end of the guide passage 511 is open to a suction chamber 442 as a suction pressure zone in the rear housing member 44 at the inner end of the rotary shaft 51. A shutter 67 is fitted into the guide passage 511 in the rotary shaft 51. The shutter 67 defines a supply passage 515 and an expansion passage 68. A restriction passage 671 is formed in the shutter 67. The expansion passage 68 and the supply passage 515 are connected to each other by the restriction passage 671. A small-diameter passage 514 communicates with the expansion passage 68.

As shown in FIG. 12, first suction passages 63, the number of which is five in this embodiment, are formed in the first cylinder block 41. The first suction passages 63 connect the associated cylinder bores 57 to the shaft hole 411. The first suction passages 63 are open to the first seal surface 412. Second suction passages 64 equal in number to the first suction passages 63 are likewise formed in the second cylinder block 42. The second suction passages 64 connect the associated cylinder bores 58 to the shaft hole 421. The second suction passages 64 are open to the second seal surface 422. As the rotary shaft 51 rotates, inlet passages 61 and 62 intermittently communicate with the associated suction passages 63 and 64.

When the double-headed piston 59 is in a stroke of moving from the top dead center to the bottom dead center (from the left-hand side to the right-hand side in FIG. 11), the first inlet passage 61 is connected to the first suction passages 63 and the second inlet passage 62 is disconnected from the second suction passages 64. Then, the refrigerant gas in the supply passage 515 in the rotary shaft 51 is sucked into the first compression chamber 571 of the first cylinder bore 57 via the first inlet passage 61 and the first suction passage 63. Further, the refrigerant in the second compression chamber 581 in the second cylinder bore 58 pushes the discharge valve 491 backward through the discharge port 481 and is discharged to the discharge chamber 441. The refrigerant discharged to the discharge chamber 441 flows to the external refrigerant circuit. The refrigerant having flown to the external refrigerant circuit circulates back to the suction chamber 442.

When the double-headed piston 59 is in a stroke of moving from the bottom dead center to the top dead center (from the right-hand side to the left-hand side in FIG. 11), the first inlet passage 61 is disconnected from the first suction passages 63 and the second inlet passage 62 is connected to the second suction passages 64. Then, the refrigerant in the first compression chamber 571 pushes the discharge valve 461 backward through the discharge port 451 and is discharged to the discharge chamber 431. The refrigerant discharged to the discharge chamber 431 flows to the external refrigerant circuit. The refrigerant having flown to the external refrigerant circuit circulates back to the suction chamber 442. Further, the refrigerant in the supply passage 515 in the rotary shaft 51 is sucked into the second compression chamber 581 of the second cylinder bore 58 via the second inlet passage 62 and the second suction passage 64.

The circuit that comprises the compressor and the external refrigerant circuit holds a lubricating oil inside that flows with the refrigerant.

Those portions of the rotary shaft 51 that are surrounded by the seal surfaces 412 and 422 serve as rotary valves 65 and 66 formed integrally on the rotary shaft 51.

Figure 13A:
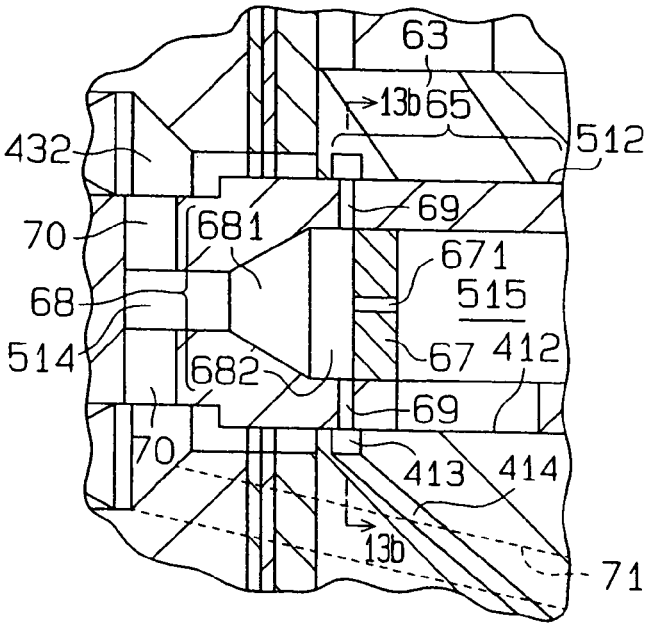
FIG. 13(*a*) is an enlarged partial cross-sectional view of the compressor in FIG. 11.
Figure 13B:
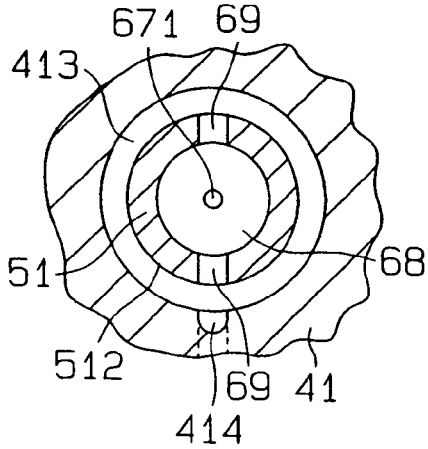

As shown in FIG. 13(*a*), the expansion passage 68 includes a cone portion 681 and a circumferential portion 682. The small-diameter passage 514 is led to the minimum-diameter portion of the cone portion 681 and the circumferential portion 682 is led to the maximum-diameter portion of the cone portion 681. The cross-sectional area of the cone portion 681 is larger than the cross-sectional area of the small-diameter passage 514 and the circumferential portion 682 has the largest cross-sectional area in the expansion passage 68.

As shown in FIGS. 13(*a*) and 13(*b*), a pair of fluid outlet ports 69 are formed in the rotary shaft 51 in such a way as to be open to the inner wall of the circumferential portion 682 and the outer surface 512 of the rotary shaft 51. An annular passage 413 that circles around the rotary shaft 51 is formed in the first seal surface 412 in such a way as to communicate with the fluid outlet ports 69.

As shown in FIG. 11, a connecting passage 414 that connects the annular passage 413 to the swash plate chamber 54 is formed in the first cylinder block 41. A pair of communication ports 70 are formed in the rotary shaft 51. The small-diameter passage 514 in the rotary shaft 51, which is led to the expansion passage 68, communicates with the retaining chamber 432 via the communication ports 70. The total value of the cross-sectional areas of the pair of communication ports 70 is set equal to or smaller than the cross-sectional area of the small-diameter passage 514.

A communication passage 71 that penetrates through the first cylinder block 41, the first main valve plate 45, the first sub valve plate 46 and the first retainer plate 47 connects the swash plate chamber 54 to the retaining chamber 432. Therefore, the swash plate chamber 54 communicates with the expansion passage 68 via the communication passage 71, the retaining chamber 432, the communication ports 70 and the small-diameter passage 514. The pair of communication ports 70, the small-diameter passage 514, the expansion passage 68 and the restriction passage 671 function as a gas passage provided in the rotary shaft 51 in such a way as to communicate with the swash plate chamber 54.

The maximum cross-sectional area of the expansion passage 68 is larger than the cross-sectional area of the small-diameter passage 514 located upstream of the expansion passage 68.

The pressure (discharge pressure) of the refrigerant in the compression chamber 571, 581 in the discharge stroke is higher than the pressure in the swash plate chamber 54, which communicates with the suction chamber 442 via the communication passage 71, the retaining chamber 432, the communication ports 70, the small-diameter passage 514, the expansion passage 68 and the restriction passage 671. Therefore, the refrigerant in the compression chamber 571, 581 leaks to the swash plate chamber 54 from the slight clearance between the outer surface of the double-headed piston 59 and the inner surface of the cylinder bores 57 and 58. Such refrigerant leakage makes the pressure in the swash plate chamber 54 slightly higher than the pressure in the supply passage 515 and the suction chamber 442, providing a pressure difference between the supply passage 515 and the swash plate chamber 54. As a result, the refrigerant in the swash plate chamber 54 flows to the supply passage 515 via the communication passage 71, the retaining chamber 432, the communication ports 70, the small-diameter passage 514, the expansion passage 68 and the restriction passage 671.

The refrigerant gas that has passed through the communication passage 71, the retaining chamber 432, the communication ports 70 and the small-diameter passage 514 receives the centrifugal action, caused by the rotation of the rotary shaft 51, in the expansion passage 68. The lubricating oil that flows with the refrigerant gas, which has passed through the communication passage 71, the retaining chamber 432, the communication ports 70 and the small-diameter passage 514, is separated from the refrigerant gas by the centrifugal action in the expansion passage 68. The separated lubricating oil is guided to each fluid outlet port 69 by the centrifugal action in the fluid outlet port 69. The lubricating oil having flown into the fluid outlet port 69 flows out into the swash plate chamber 54 via the annular passage 413 and the connecting passage 414 by the centrifugal action in the fluid outlet port 69. The lubricating oil having flown into the swash plate chamber 54 from the expansion passage 68 is used to lubricate portions in the swash plate chamber 54, which need lubrication The fluid outlet ports 69, the annular passage 413 and the connecting passage 414 constitute a fluid passage that extends from the expansion passage 68 to the swash plate chamber 54 penetrating the outer surface 512 of the rotary shaft 51.

This embodiment has the following advantage in addition to the first described advantage of the first embodiment in FIGS. 1 to 4(*b*).

As there is a steady flow of the refrigerant in the communication passage 71, the retaining chamber 432 and the communication ports 70, the lubricating oil that flows with the refrigerant is successively fed to the retaining chamber 432 from the swash plate chamber 54 and flows to the expansion passage 68 from the retaining chamber 432. Part of the lubricating oil that is fed to the retaining chamber 432 from the swash plate chamber 54 via the communication passage 71 contributes to lubrication of the shaft sealing assembly 52.

It should be apparent to those skilled in the art that the present invention may be embodied in many other specific forms without departing from the spirit or scope of the invention. Particularly, it should be understood that the invention may be embodied in the following forms.

The present invention may be adapted to a piston type compressor that does not use a rotary valve.

The present invention may also be adapted to a piston type compressor that has a driving body with a shape different from that of a swash plate.

The present examples and embodiments are to be considered as illustrative and not restrictive and the invention is not to be limited to the details given herein, but may be modified within the scope and equivalence of the appended claims.

The invention claimed is:

1. A compressor with a lubrication structure, comprising:
a rotary shaft;
a piston;
a suction pressure zone, the internal pressure of which is suction pressure;
a driving body accommodating chamber;
a driving body accommodated in the driving body accommodating chamber, wherein the driving body converts rotation of the rotary shaft into reciprocation of the piston, thereby causing the piston to compress gas;
a gas passage that extends through the rotary shaft and communicates with the driving body accommodating chamber so that gas in the driving body accommodating chamber flows into the gas passage, wherein the gas passage includes an expansion portion formed in the rotary shaft along the axis of the rotary shaft, and wherein the expansion portion connects to the suction pressure zone so that the gas in the expansion portion flows into the suction pressure zone; and
a fluid passage formed in the rotary shaft opening at one end to the expansion portion and at the other end to the driving body accommodation chamber,
wherein the maximum cross-sectional area of the expansion portion is greater than the maximum cross-sectional area of a section of the gas passage that is upstream of the expansion portion with regard to gas flow in the gas passage.

2. The compressor according to claim 1, wherein the fluid passage extends in a direction orthogonal to the axis of the rotary shaft.

3. The compressor according to claim 1, wherein the expansion portion has an upstream end and a downstream end with regard to the gas flow, and the cross-sectional area of the expansion portion gradually increases from the upstream end toward the downstream end.

4. The compressor according to claim 1, further comprising:
a discharge pressure zone, the internal pressure of which is discharge pressure;
a feed passage connecting the discharge pressure zone with the driving body accommodating chamber; and
a bleed passage connecting the driving body accommodating chamber with the suction pressure zone,
wherein the bleed passage functions as the gas passage, wherein the pressure in the driving body accommodating chamber is adjusted by supplying gas in the discharge pressure zone to the driving body accommodating chamber through the feed passage, and bleeding gas in the driving body accommodating chamber to the suction pressure zone through the bleed passage, and wherein a displacement of the compressor is controlled according to the pressure in the driving body accommodating chamber.

5. The compressor according to claim 4, further comprising a plurality of cylinder bores arranged around an axis of the rotary shaft, wherein the piston is one of a plurality of pistons each of which is accommodated in one of the cylinder bores, each piston defining a compression chamber in the associated cylinder bore, wherein the compressor further comprises a rotary valve that has an inlet passage for drawing gas from the suction pressure zone to the compression chambers, wherein the rotary valve includes a supply passage connecting the inlet passage with the suction pressure zone, and wherein the expansion portion communicates with the supply passage through a restriction passage.

6. The compressor according to claim 5, wherein the rotary valve is coupled to the rotary shaft to integrally rotate with the rotary shaft.

7. The compressor according to claim 6, wherein the restriction passage is located in the rotary valve.

8. The compressor according to claim 7, wherein the rotary shaft has one end at which the expansion portion opens, and the rotary valve has one end at which the restriction passage opens, and wherein the one end of the rotary valve is fitted to the one end of the rotary shaft.

9. The compressor according to claim 5, wherein the rotary valve is a part of the rotary shaft, and wherein a shutter having the restriction passage is located in the rotary shaft.

10. The compressor according to claim 5, wherein the restriction passage and the supply passage function as the bleed passage.

11. The compressor according to claim 5, wherein the restriction passage is located on the axis of the rotary valve.

12. The compressor according to claim 1, wherein the gas is a refrigerant containing lubricating oil.

13. A compressor with a lubrication structure, comprising:
a rotary shaft;
a piston;
a suction pressure zone, the internal pressure of which is suction pressure;
a swash plate chamber;
a swash plate that is accommodated in the swash plate chamber and supported on the rotary shaft, wherein the swash plate converts rotation of the rotary shaft into reciprocation of the piston, thereby causing the piston to compress refrigerant, the refrigerant containing lubricating oil;
a refrigerant passage that includes an inlet, a guide passage and an expansion portion, wherein the inlet communicates with the swash plate chamber so that refrigerant in the swash plate chamber is introduced into the inlet and flows into the suction pressure zone through the guide passage and the expansion portion, and wherein the guide passage and the expansion portion are formed coaxially along the axis of the rotary shaft; and
a fluid passage formed in the rotary shaft in a direction orthogonal to the axis of the rotary shaft to connect at one end to the expansion portion and at the other end to the swash plate chamber,
wherein the maximum cross-sectional area of the expansion portion is greater than the maximum cross-sectional area of the guide passage.

14. The compressor according to claim 13, wherein the expansion portion has an upstream end connected to the guide passage and a downstream end opposite to the upstream end with regard to the refrigerant flow, and the cross-sectional area of the expansion portion gradually increases from the upstream end toward the downstream end.

15. The compressor according to claim 13, further comprising:
a discharge pressure zone, the internal pressure of which is discharge pressure;
a feed passage connecting the discharge pressure zone with the swash plate chamber; and
a bleed passage connecting the swash plate chamber with the suction pressure zone,
wherein the bleed passage functions as the refrigerant passage, wherein the pressure in the swash plate chamber is adjusted by supplying refrigerant in the discharge pressure zone to the swash plate chamber through the feed passage, and bleeding refrigerant in the swash plate chamber to the suction pressure zone through the bleed passage, and wherein a displacement of the compressor is controlled according to the pressure in the swash plate chamber.

16. The compressor according to claim 13, further comprising a plurality of cylinder bores arranged around an axis of the rotary shaft, wherein the piston is one of a plurality of pistons each of which is accommodated in one of the cylinder bores, each piston defining a compression chamber in the associated cylinder bore, wherein the compressor further comprises a rotary valve that has an inlet passage for drawing refrigerant from the suction pressure zone to the compression chambers, wherein the rotary valve includes a supply passage connecting the inlet passage with the suction pressure zone, and wherein the expansion portion communicates with the supply passage through a restriction passage.

17. The compressor according to claim 16, wherein the rotary valve is coupled to the rotary shaft to integrally rotate with the rotary shaft.

18. The compressor according to claim 17, wherein the restriction passage is located in the rotary valve.

19. The compressor according to claim 18, wherein the rotary shaft has one end at which the expansion portion opens, and the rotary valve has one end at which the restriction passage opens, and wherein the one end of the rotary valve is fitted to the one end of the rotary shaft.

20. The compressor according to claim 16, wherein the rotary valve is a part of the rotary shaft, and wherein a shutter having the restriction passage is located in the rotary shaft.

* * * * *

UNITED STATES PATENT AND TRADEMARK OFFICE

CERTIFICATE OF CORRECTION

PATENT NO. : 7,458,785 B2
APPLICATION NO. : 10/770730
DATED : December 2, 2008
INVENTOR(S) : Tomohiro Murakami et al.

It is certified that error appears in the above-identified patent and that said Letters Patent is hereby corrected as shown below:

Column 5, line 22, please delete "(driving body accommodating chamber.)," and insert therefore -- (driving body accommodating chamber), --;

Column 5, lines 37 and 39-40, please delete "The lubricating oil having flown into" and insert therefore -- The lubricating oil having flowed into --;

Column 6, line 6, please delete "there is very small ratio" and insert therefore -- there is a very small ratio --;

Column 8, line 66, please delete "The refrigerant having flown to the external refrigerant" and insert therefore -- The refrigerant having flowed to the external refrigerant --;

Column 9, line 11, please delete "The refrigerant having flown to the external refrigerant" and insert therefore -- The refrigerant having flowed to the external refrigerant --; and Column 10, lines 29 and 32-33, please delete "The lubricating oil having flown into" and insert therefore -- The lubricating oil having flowed into --.

Signed and Sealed this

Eighteenth Day of August, 2009

David J. Kappos

David J. Kappos
*Director of the United States Patent and Trademark Office*